US005115843A

United States Patent [19]

Bayliss

[11] Patent Number: 5,115,843

[45] Date of Patent: May 26, 1992

[54] COMMON BASE FOR A PLURALITY OF MODULAR FILLERS

[75] Inventor: William M. Bayliss, Fresno, Calif.

[73] Assignee: FMC Corporation, Chicago, Ill.

[21] Appl. No.: 610,614

[22] Filed: Nov. 8, 1990

[51] Int. Cl.[5] ..... B65B 1/04

[52] U.S. Cl. ..... 141/1; 141/144

[58] Field of Search ..... 141/1, 4, 5, 144, 145, 141/146, 147, 151, 152, 177

[56] References Cited

U.S. PATENT DOCUMENTS

| | | | |
|---|---|---|---|
| 1,761,383 | 6/1930 | Bergmann | 141/177 X |
| 1,773,657 | 8/1930 | White | 141/177 X |
| 1,828,167 | 10/1931 | Ayars | 141/144 X |
| 2,517,592 | 8/1950 | Nordquist | 141/152 X |
| 3,580,299 | 5/1971 | Alkalay et al. | 141/147 X |
| 3,580,302 | 5/1971 | Riesenberg | 141/152 X |
| 3,779,292 | 12/1973 | Mencacci | 141/11 |
| 4,588,001 | 5/1986 | Leonard | 141/145 X |
| 4,869,397 | 9/1989 | Corniea et al. | 141/147 X |

*Primary Examiner*—Thomas B. Will
*Assistant Examiner*—G. Bradley Bennett
*Attorney, Agent, or Firm*—A. J. Moore; R. C. Kamp; R. B. Megley

[57] ABSTRACT

A common base for a plurality of fillers is disclosed for supporting a plurality of type of container fillers. A common drive system for the plurality of fillers is supported by a single plate, and drives a star wheel for moving containers below a plurality of filler valves for receiving a predetermined volume of flowable product. The power means rotates a plurality of selected types of filling valves, and means are provided for raising and lowering pistons in said cylinders for filling containers of variable sizes.

5 Claims, 3 Drawing Sheets

COMMON BASE FOR A PLURALITY OF MODULAR FILLERS

BACKGROUND OF THE INVENTION

1. Field of the Invention

The present invention relates to method and apparatus for providing a variety of modular food and non-food fillers mounted on a common support base for enhancing the modular range of filling equipment to meet future market needs, reduce maintenance, and reducing rebuilding and change-over costs. The common base for a plurality of fillers creates maximum flexibility for filler users by providing them with a closely synchronized, modular filling system which provides minimum changeover time when changing filler types at a greatly reduced cost due to the common frame size, common change parts, filling cylinders, and drive components for all filling concepts thereby reducing part replacement and maintenance costs.

2. Description of the Prior Art

Assignee's Creed et al. U.S. Pat. No. 4,936,072 illustrates a flat table top conveyor chain with container pusher lugs pivotally attached together and capable of pivoting about horizontal and vertical axes. The Creed et al patent may be modified to be one of the plurality of modular fillers supported on the common base of the present invention.

SUMMARY OF THE INVENTION

The common base for a plurality of modular fillers of the present invention is adapted to removably support a plurality of different types of rotary fillers having similar pitch circles diameters such as granular fillers, piston fillers, prevacuum syruping fillers, and weight fillers, each providing the option of the standard tangential discharge or straight-line discharge. This provides the user with a high level of flexibility in altering his equipment to fit changing filling needs, without requiring the purchase of a new base frame for each type of filler. The modular design is also compatible with the requirements for deposit, fill and seal equipment.

DESCRIPTION OF THE PREFERRED EMBODIMENT

Figure 1:
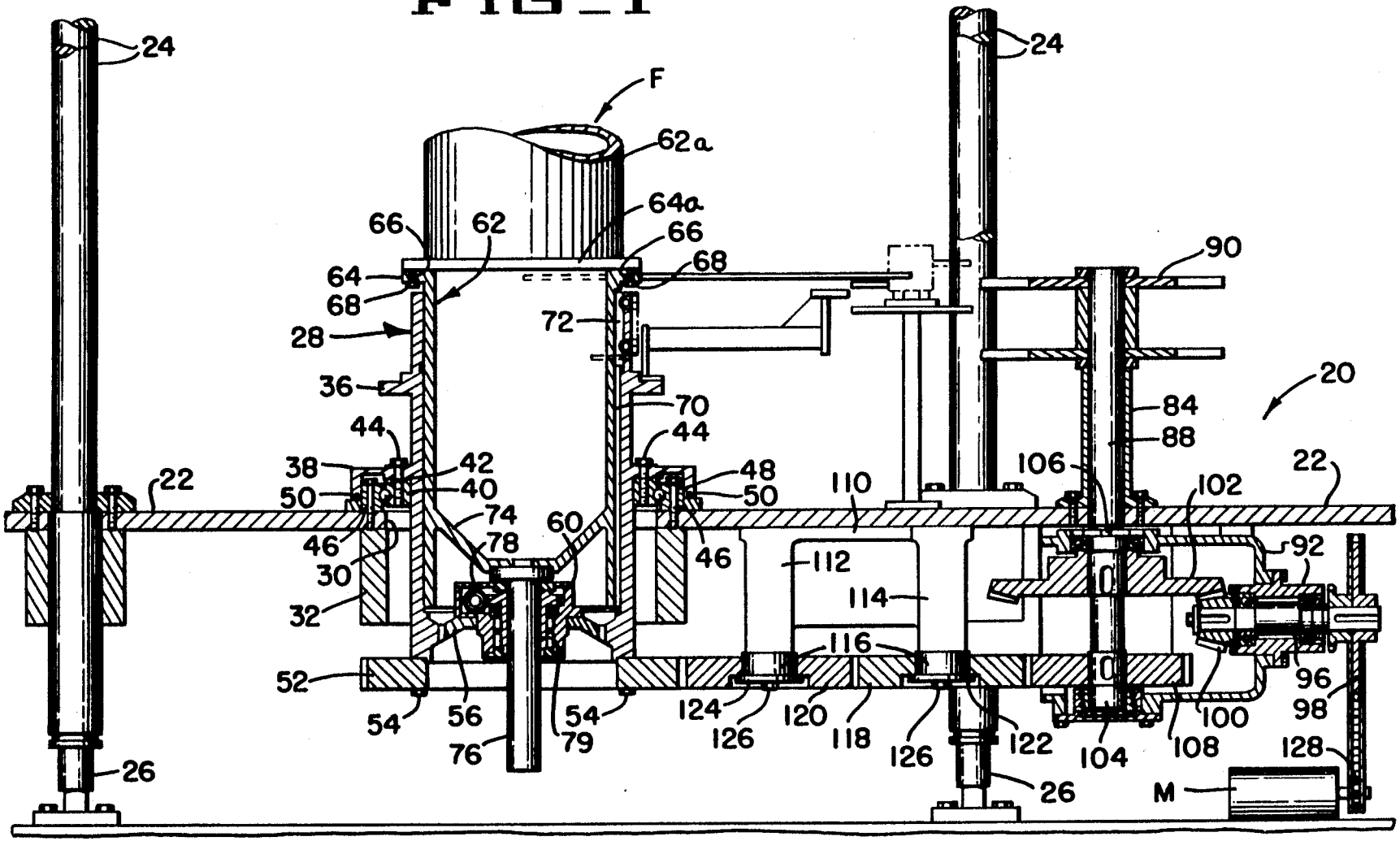
FIG. 1 is a central section through the base frame of the modular filler of the present invention, illustrating one type of a plurality of fillers mounted on the common base frame which is in the form of a known carbonated beverage filler.

The common base 20 for a plurality of modular fillers of the present invention includes a mounting plate 22 supported on four legs 24, which plate may be adjusted vertically by hydraulic cylinders 26 for accommodating different types of fillers F (FIGS. 2 and 3) and Fa (FIGS. 4 and 5), only two being shown. A plurality of openings are provided in the plate 22 for receiving certain components which extend above and/or below the mounting plate 22. A center column 28 extends through a large opening 30 in the mounting plate 22, which plate is stiffened by a large diameter ring 32. The center column bushing 28 includes an intermediate flange 36 and a lower L-shaped flange 38 which has an inner race 40 of an annular ball bearing 42 secured to the lower flange 38 by a plurality of cap screws 44. An outer race 46 is secured to the plate 22 by a second plurality of cap screws 48, and an annular seal 50 is supported on the plate 22, which cooperates with the L-shaped flange 38 to prevent contaminates from entering the bearing 42. An annular filler drive gear 52 is connected to the lower end of the center column bushing 28 by a plurality of cap screws 54. A lower flange 56 of the center column bushing 28 rigidly supports a worm wheel housing 60.

A center column 62 has a flanged upper edge 64 with a plurality of evenly spaced opening 66 therein for receiving cap screws 68 which connect ones of a plurality of fillers F thereto. An elongated, vertical keyway 70 is formed in the outer surface of the center column bushing 28 and receives a key 72 connected to the center column 62 permitting the center column to rotate with the center column bushing 28, and also permits the center column 62 to move vertically thereby providing adjustment means for permitting batches of containers of different heights to be filled.

As illustrated in FIG. 1, the center column 62 includes an intermediate wall 74 to which an elongated vertically extending threaded worm gear 76 is secured. The threaded worm gear shaft 76 is received within the worm wheel housing 60. An externally threaded worm gear 78 is rotatably received in the worm gear housing 60, and has external threads (not shown) thereon which mesh with threads (not shown) on an internally and externally threaded worm wheel 79. The worm gear 78 may be operated by a hand crank or by a motor (not shown) for vertically adjusting the central column 62 and a first filler F (FIGS. 2 and 3) supported thereon thereby allowing the filler F to fill batches of containers of different heights. Alternately, a plurality of different types of fillers, such as fillers Fb illustrated in FIGS. 4 and 5 may be mounted on the central column 62 (FIG. 1).

Having reference to FIG. 1, a flanged tubular housing 84 is bolted to the mounting plate 22 and has a flanged upper end which receives a bearing (not shown) for rotatably receiving a shaft 88. A star wheel 90 is rigidly secured to the upper end of the shaft 88 for feeding containers into the filler F.

An open ended gear box 92 is rigidly secured to the undersurface of the mounting plate 22, and has a horizontal tubular opening therein which rotatably receives a shaft 96 having a sprocket 98 keyed to one end and a pinion 100 keyed to the other end of the shaft 96. The pinion 100 meshes with a bevel gear 102 keyed to a vertical stub-shaft 104, which stub-shaft is journaled in the gear box 92 and is removably connected to the shaft 88 by a key 106. A spur gear 108 is also keyed to the stub-shaft 104.

An inverted U-shaped bracket 110 is rigidly secured to the undersurface of the mounting plate 22 and includes two downwardly projecting legs 112,114, each of which has a reduced diameter lower surface which receives roller bearing 116 and idler gears 118,120 which are held in place on the legs 112,114 by plates 122,124 and cap screws 126. The idler gear 120 meshes with the gear 52 thus rotating the central column bushing 28 and the center column 62 when driven by a motor M connected to a sprockets 98 and 128 (FIG. 1).

As mentioned previously, the inventive concept of the present invention provides a common base mounting plate 22 (FIG. 1) for a plurality of different types of rotary fillers having the same pitch circle diameter.

Figure 2:
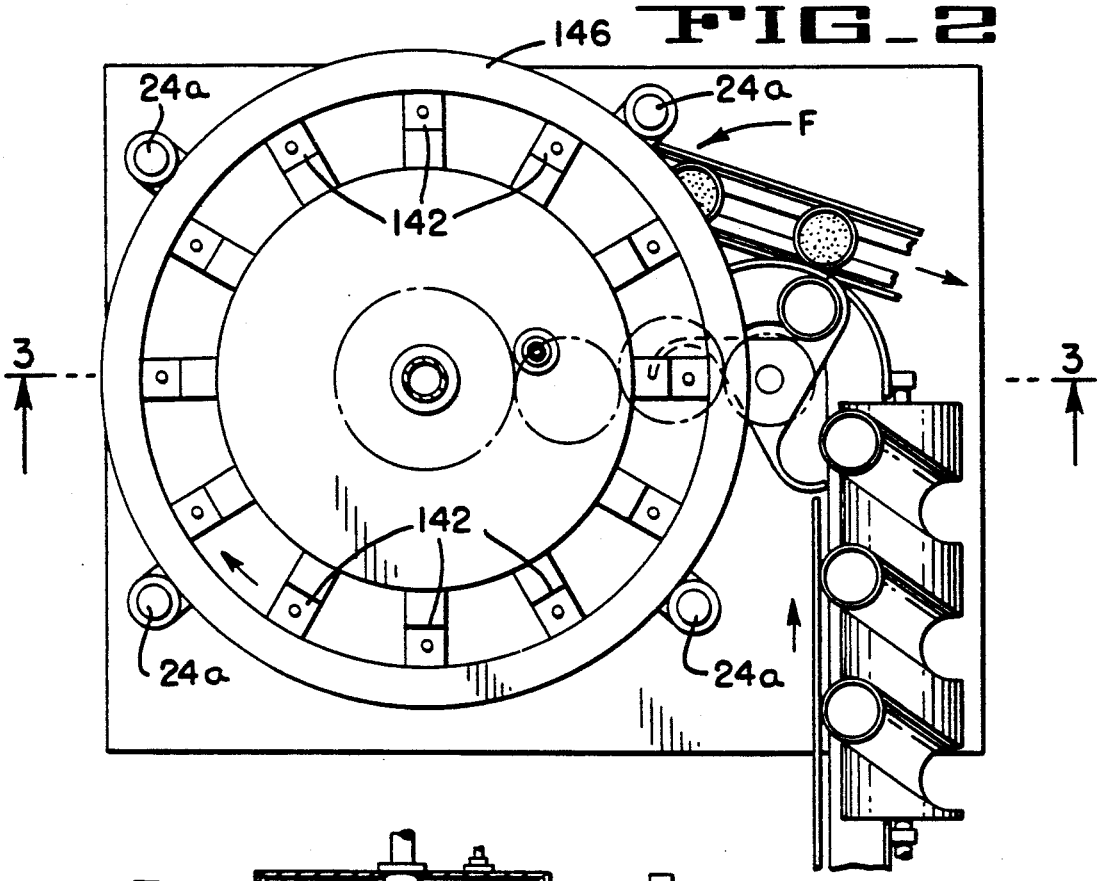
FIG. 2 is a plan view of a first slightly modified known filler type having a tangential discharge.
Figure 3:
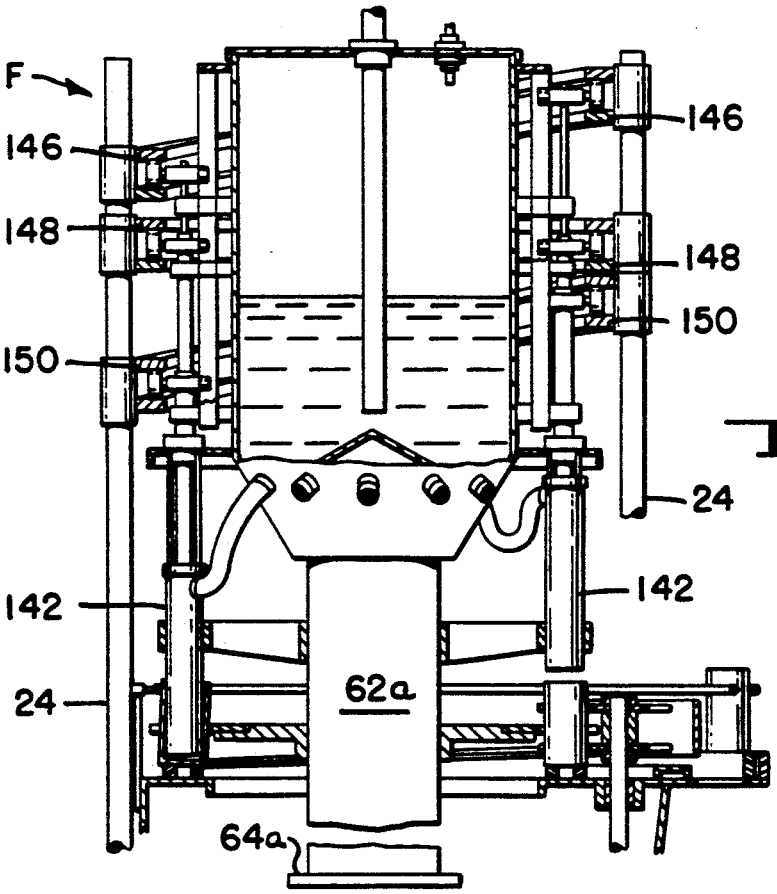
FIG. 3 is a central vertical section taken along lines 3—3 of FIG. 2.

FIGS. 2 and 3 illustrate a first type of filler in the form of a modified carbonated beverage filler F of the type disclosed in Assignee's Mencacci U.S. Pat. No. 3,779,292 entitled Carbonated Beverage Filler which issued on Dec. 18, 1973.

The filler F is modified relative to that disclosed in the Mencacci patent by providing a flanged edge 64*a* (FIG. 3) of a central column 62*a* slidably received in the center column bushing 28 (FIG. 1) thus using the mounting plate 22 of the previously described common base 20 (FIG. 1) for supporting a plurality of the Mencacci type filler valve assemblies 142 (FIGS. 2 and 3). Twelve filler valve assemblies and three cam tracks 146,148 and 150 would likewise be moved outwardly for support on the four legs 24*a* (FIG. 2), only two of the four legs 24*a* being shown in FIG. 3.

Figure 4:
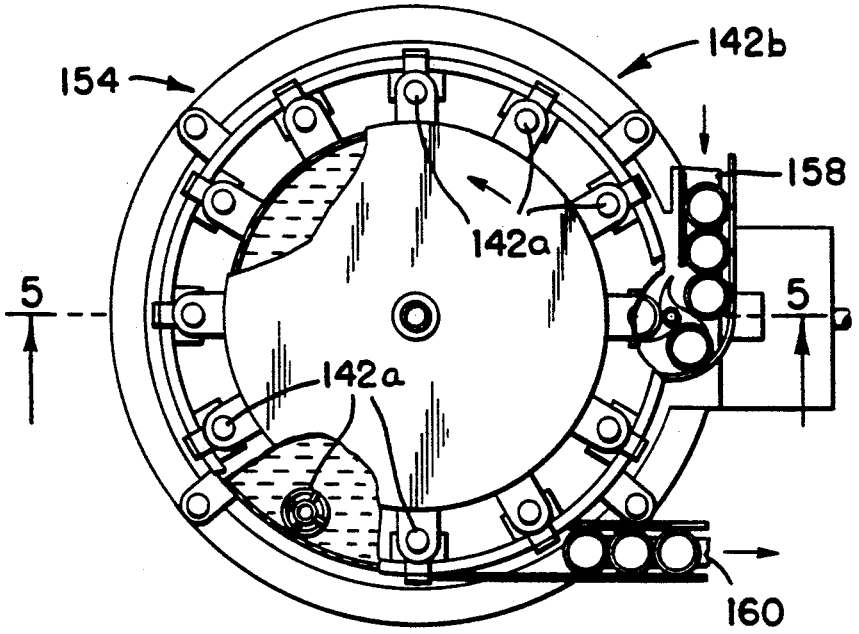
FIG. 4 is a plan view of a second slightly modified known positive displacement filler type which may be modified for use on the common base of the present invention.
Figure 5:
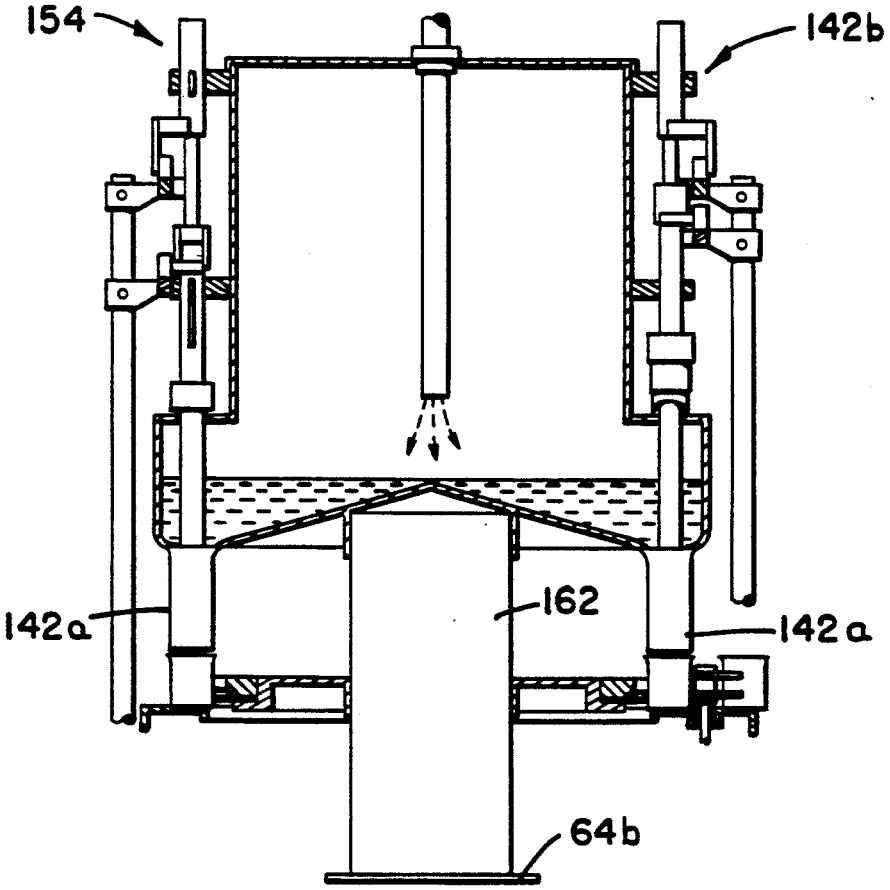
FIG. 5 is a modified section taken along lines 5—5 of FIG. 4.

FIGS. 4 and 5 illustrate a second modified filling machine 154 of the type disclosed in Assignee's Billett et al. U.S. Pat. No. 3,830,264 entitled Positive Displacement Filling Machine which issued on Aug. 20, 1974.

As illustrated in FIGS. 4 and 5, the Billett et al modified filler 154 includes twelve positive displacement valves 142*a* and has a tangential container inlet 158 and a non-tangential container outlet 160. The modified filler 154 includes a flanged column 162 bolted to the mounting flange 64 of the center column 62 (FIG. 1) for supporting the pistons and cylinders of the Billett et al filler, thus permitting the use of the previously described common base 20 (FIG. 1) for supporting and driving the filling components of the modified Billett et al filler.

Other conventional fillers may also be mounted on the common base of a plurality of modular fillers of the present invention.

From the foregoing description it will be apparent that a common base and drive system is disclosed for supporting a plurality of different types of fillers thus enhancing the modular range of filling equipment to meet future market needs, reduce filling maintenance, rebuilding costs and change-over costs.

Although the best mode contemplated for carrying out the present invention has been herein shown and described, it will be apparent that modification and variation may be made without departing from what is regarded to be the subject matter of the invention.

What is claimed is:

1. In an apparatus for selectively supporting a plurality of types of container fillers on a common adjustable frame; comprising:

means defining a mounting plate having a plurality of openings therein;

means defining a plurality of legs for supporting said mounting plate at selected ones of a plurality of desired elevations;

means defining a rotatable center column bushing supported on and extending partially through said mounting plate and having a vertical key attached thereto;

means defining a rotatable and vertically adjustable center column slidably received within said rotatable center column bushing and having an elongated vertically extending keyway therein for slidably receiving said vertical key;

means defining one of a plurality of types of container fillers removably secured to said rotatable center column for rotation and vertical movement therewith; and drive means for rotating said vertically adjustable central column and attached ones of said plurality of fillers for dispensing a flowable product into containers (FIGS. 2 and 4) supported by said filler and said mounting plate.

2. An apparatus according to claim 1 wherein said drive means includes a motor and drive train operatively connected to said mounting plate.

3. An apparatus according to claim 2 and additionally comprising means for raising and lowering said vertically adjustable center column and filler supported thereon.

4. An apparatus according to claim 3 wherein said means for vertically adjusting said center column comprises:

a vertically extending worm gear operatively connected to said center column;

means defining an internally threaded worm wheel; and means for manually rotating said worm wheel in desired directions for raising and lowering said rotatable center column.

5. A method for selectively supporting a plurality of types of container fillers on a common vertically adjustable frame, comprising the steps of:

supporting a mounting plate at a desired elevation on a plurality of legs;

rotating a center column bushing supported on said mounting plate;

vertically adjusting a center column slidably received within said center column bushing; and maintaining said center column from rotation relative to said center column bushing thereby allowing associated ones of said container fillers to fill batches of containers of different height.

* * * * *